US008640592B1

(12) United States Patent
Gabrys et al.

(10) Patent No.: US 8,640,592 B1
(45) Date of Patent: Feb. 4, 2014

(54) BLAST PRESSURE DIFFUSER

(75) Inventors: Jonathan W. Gabrys, Downingtown, PA (US); Dinesh J. Trivedi, Wilmington, DE (US)

(73) Assignee: The Boeing Company, Chicago, IL (US)

( * ) Notice: Subject to any disclaimer, the term of this patent is extended or adjusted under 35 U.S.C. 154(b) by 206 days.

(21) Appl. No.: 13/070,377

(22) Filed: Mar. 23, 2011

(51) Int. Cl.
*F41H 5/24* (2006.01)
*B60J 7/00* (2006.01)

(52) U.S. Cl.
USPC ..... 89/36.04; 89/36.07; 296/187.07

(58) Field of Classification Search
USPC ..... 89/36.04, 36.08; 296/187.07
See application file for complete search history.

(56) References Cited

U.S. PATENT DOCUMENTS

| | | | | | |
|---|---|---|---|---|---|
| 860,378 | A * | 7/1907 | Hibbard | 114/10 |
| 2,376,331 | A * | 5/1945 | Abrams | 89/36.08 |
| 3,504,644 | A * | 4/1970 | Schibisch | 109/49.5 |
| 3,765,299 | A * | 10/1973 | Pagano et al. | 89/36.08 |
| 4,192,216 | A | 3/1980 | Wait | |
| 4,325,283 | A * | 4/1982 | Bemiss | 89/36.07 |
| 4,326,445 | A * | 4/1982 | Bemiss | 296/187.07 |
| 4,326,468 | A | 4/1982 | King et al. | |
| 4,957,034 | A * | 9/1990 | Tasdemiroglu | 89/36.02 |
| 5,452,641 | A | 9/1995 | Kariya | |
| 5,533,781 | A * | 7/1996 | Williams | 296/204 |
| 5,641,933 | A * | 6/1997 | Kim | 89/36.02 |
| 5,663,520 | A * | 9/1997 | Ladika et al. | 296/187.07 |
| 5,880,394 | A * | 3/1999 | Kim | 89/36.02 |
| 6,672,195 | B1 * | 1/2004 | Plattner | 89/36.11 |
| 6,813,986 | B1 * | 11/2004 | Tafoya et al. | 86/50 |
| 6,921,117 | B2 * | 7/2005 | Rackham et al. | 293/115 |
| 7,080,587 | B2 | 7/2006 | Benyami et al. | |
| 7,597,040 | B2 * | 10/2009 | Gabrys | 89/36.02 |
| 7,779,742 | B2 * | 8/2010 | Benyami et al. | 89/36.17 |
| 8,052,200 | B2 * | 11/2011 | Bharani et al. | 296/190.08 |
| 8,132,495 | B2 * | 3/2012 | Joynt | 89/36.08 |
| 8,146,477 | B2 * | 4/2012 | Joynt | 89/36.08 |
| 8,205,933 | B2 * | 6/2012 | Boczek et al. | 296/181.1 |
| 8,336,440 | B2 * | 12/2012 | Mills et al. | 89/36.08 |
| 2007/0144337 | A1 * | 6/2007 | Zhang et al. | 89/36.01 |
| 2008/0066613 | A1 * | 3/2008 | Mills et al. | 89/36.09 |
| 2008/0105114 | A1 * | 5/2008 | Gabrys | 89/36.02 |
| 2010/0095832 | A1 | 4/2010 | Gabrys | |
| 2010/0307327 | A1 * | 12/2010 | Gettle | 89/36.02 |
| 2010/0307329 | A1 * | 12/2010 | Kaswen et al. | 89/36.08 |
| 2010/0319525 | A1 * | 12/2010 | Pavon | 89/36.02 |
| 2012/0152101 | A1 * | 6/2012 | Engleman et al. | 89/36.08 |
| 2012/0174767 | A1 * | 7/2012 | Naroditsky et al. | 89/36.08 |

OTHER PUBLICATIONS armytechnology.com, "Joint Light Tactical Vehicle (JLTV) Support Vehicle," <http://www.army-technology.com/projects/jltv/>, last visited Feb. 4, 2011.

Bae Systems, "Equipment Installation Instructions and Parts List for the Heavy Expanded Mobility Tactical Truck (HEMTT) Gen IIIA Crew Protection Armor Kit," Jun. 9, 2005.

* cited by examiner

*Primary Examiner* — Michelle Clement

(57) ABSTRACT

A blast diffuser for a structure may include a diffuser assembly. The diffuser assembly may include a plurality of vanes arranged in spaced relation to one anther. The vanes may be configured to redirect airflow of an overpressure wave from a first direction toward the diffuser assembly to a second direction generally parallel to the structure. The vanes may be offset from the structure by an offset distance forming a gap for the airflow between the vanes and the structure.

13 Claims, 11 Drawing Sheets

BLAST PRESSURE DIFFUSER

FIELD

The present disclosure relates generally to explosion protection systems and, more particularly, to systems for reducing the effects of an overpressure wave from an explosion.

BACKGROUND

Light tactical vehicles are commonly used by military organizations for a variety of purposes such as reconnaissance, cargo and troop transport, and as general purpose utility vehicles. The most common light tactical vehicle currently used in military operations is a four-wheel-drive vehicle designated the High Mobility Multipurpose Wheeled Vehicle (HMMWV), more commonly referred to as the Humvee. Light tactical vehicles such as the Humvee may include relatively light armor plating and bullet-resistant glass mounted to the passenger compartment to improve survivability against low-intensity ballistic attacks.

Armor plating and bullet-resistant glass may be effective in protecting the Humvee against threats such as small arms fire directed primarily toward the lateral sides of the vehicle. In addition, such armor plating may be effective in protecting the vehicle against explosions adjacent to the vehicle sides and where an overpressure wave is produced by the explosion. The overpressure wave may be characterized as a shock front of relatively high pressure air (e.g., 100 psi or higher) emanating from the explosive device and moving at a relatively high velocity (e.g., 1500 mile/hour or greater). During an explosion adjacent to the lateral sides of a vehicle, the overpressure wave is generally unconfined and may disperse in multiple directions which may minimize the effects of the impact of the overpressure wave against the vehicle.

However, a potentially more dangerous situation may occur when the vehicle is exposed to landmines and improvised explosive devices (IEDs) that are buried in roads. An explosion from a landmine in the confined space between the vehicle and the road may result in an overpressure wave that may impact the floor of the passenger compartment. The overpressure wave from a landmine may have a higher intensity than an explosion near the lateral sides of the vehicle due to the relatively close proximity of the charge (e.g., landmine) to the vehicle. The impact of the overpressure wave against the floor of the passenger compartment may result in a rapid dynamic structural response of the floor, as well as a breach in the vehicle hull, both having the potential for causing serious injury to troops in the vehicle. The rapid movement of the floor may also generate an overpressure wave within the confined space of the passenger compartment which may present the risk of injury to generally hollow body organs or organs that contain air. Such organs may include the ears, the lungs, the brain, and other relatively hollow organs.

In order to increase survivability of the vehicle and occupants, troops have added makeshift armor to the vehicle. Unfortunately, the makeshift armor increases overall vehicle weight which reduces vehicle performance. For example, the increased vehicle weight may adversely affect vehicle acceleration and braking and reduce vehicle reliability due to additional stress on the vehicle components from the added weight. Vehicle handling may also suffer as a result of a higher center of gravity of the heavier vehicle. The higher center of gravity of the vehicle may also increase susceptibility of the vehicle to tipping over.

As can be seen, there exists a need in the art for a system and method for protecting the underside of a vehicle from a high-intensity overpressure blast from a landmine or similar explosive device. Preferably, such a system is of low weight to minimize adverse effects on vehicle performance.

BRIEF SUMMARY

The above-described needs associated with overpressure blasts are specifically addressed and alleviated by the present disclosure which, in an embodiment, provides a blast diffuser for a structure. The blast diffuser may include a diffuser assembly. The diffuser assembly may include a plurality of vanes arranged in spaced relation to one anther. The vanes may be configured to redirect airflow of an overpressure wave from a first direction toward the diffuser assembly to a second direction generally parallel to the structure. The vanes are offset from the structure by an offset distance forming a gap for the airflow between the vanes and the structure.

Also disclosed is a system for protecting a structure against an overpressure wave. The system may comprise a blast plate that may be mounted to the structure. The system may further include a diffuser assembly mounted over the blast plate and which may include a plurality of vanes mounted in spaced relation to one another and positioned at an offset distance from the blast plate and forming a gap between the vanes and the blast plate. The vanes may be oriented to redirect airflow of the overpressure wave from a first direction toward the structure to a second direction along the gap and generally parallel to the structure.

The present disclosure further includes a method of protecting a structure against an overpressure wave. The method may include redirecting airflow of the overpressure wave from a first direction generally toward the structure to a second direction generally parallel to the structure. The method may further include passing the airflow through a gap between a plurality of vanes and the structure when directing the airflow along the second direction.

The features, functions and advantages that have been discussed can be achieved independently in various embodiments of the present disclosure or may be combined in yet other embodiments, further details of which can be seen with reference to the following description and drawings below

BRIEF DESCRIPTION OF THE DRAWINGS

These and other features of the present disclosure will become more apparent upon reference to the drawings wherein like numerals refer to like parts throughout and wherein.

DETAILED DESCRIPTION

Figure 1:
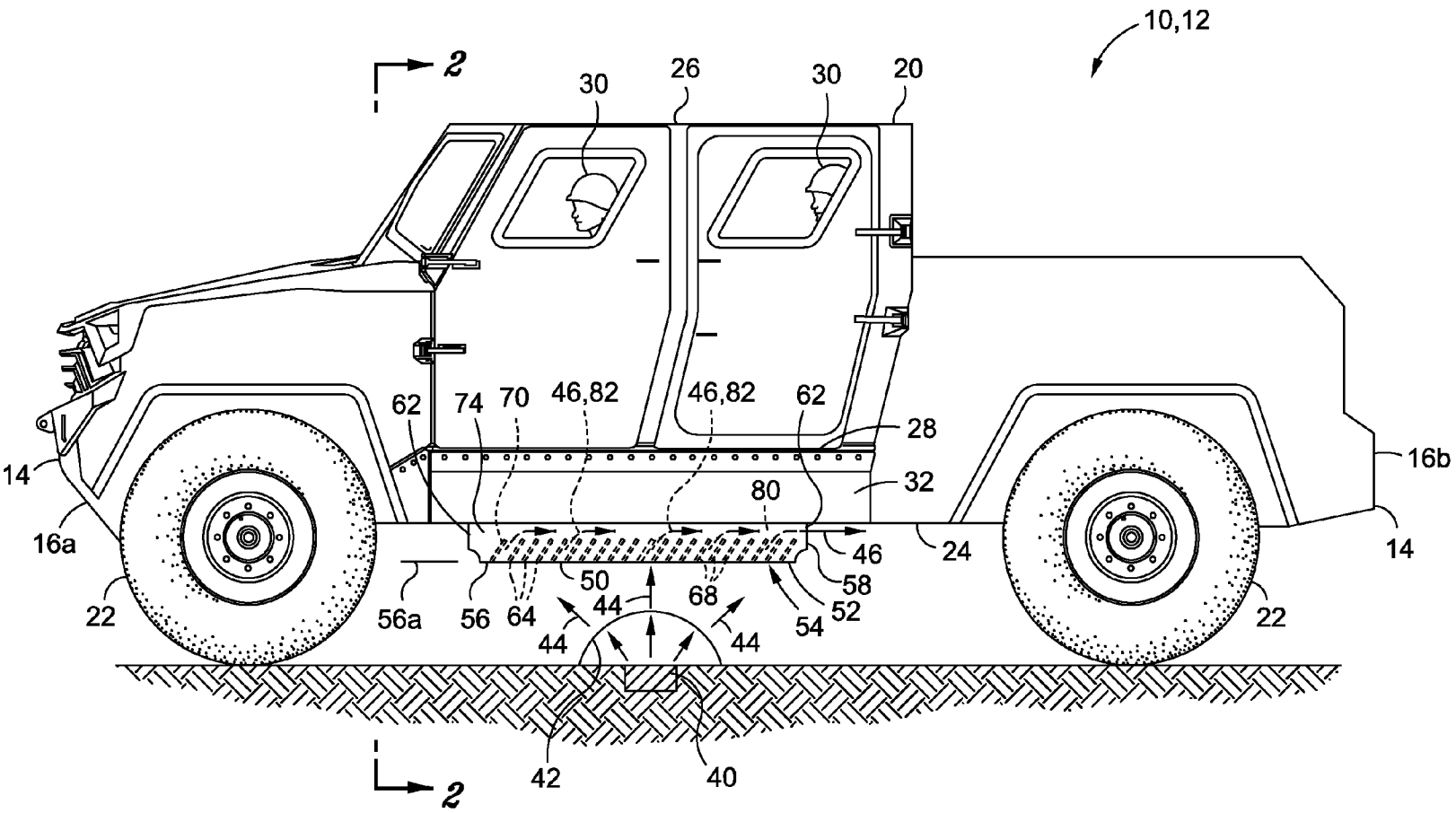
FIG. 1 is a side view of a vehicle having a blast diffuser mounted to an underside of the vehicle.

Referring now to the drawings wherein the showings are for purposes of illustrating preferred and various embodiments of the disclosure, shown in FIG. 1 is a side view of a vehicle 12 having a blast diffuser 52 mounted to an underside 24 of the vehicle 12. The blast diffuser 52 may comprise a system 50 for protecting a structure 10, such as the vehicle 12, against an overpressure wave 42 that may be generated by an explosion from an explosive device 40 such as a landmine. The vehicle 12 may include a body 20 and/or frame and may be supported by wheels 22, tracks (not shown) or any other mechanism facilitating movement of the vehicle 12. The vehicle 12 body 20 may include a passenger compartment 26 which may contain occupants 30 such as military troops and/or which may also contain cargo and/or equipment. The vehicle 12 may extend between forward and aft ends 16*a*, 16*b* of the vehicle 12. The forward and aft ends 16*a*, 16*b* may at least partially define a perimeter 14 of the vehicle 12. The system 50 may include one or more blast plates 32 which may be mounted to the vehicle 12 such as to the underside 24 of the vehicle 12 as described below.

FIG. 1 further illustrates the explosive device 40 such as a landmine or other high-energy ordnance underneath the vehicle 12. The explosive device 40 may generate a relatively high-energy shock front or overpressure wave 42 upon detonation of the explosive device 40. The overpressure wave 42 may expand rapidly outwardly from the explosive device 40 after detonation. The overpressure wave 42 may comprise an airflow 82 of relatively high air pressure (e.g., 100 psi or higher) moving at a relatively high velocity (e.g., 1500 mile/hour or higher) although lower air pressures and velocities are possible. The air pressure and velocity of the overpressure wave 42 may be dependent upon the configuration of the explosive device, the distance from the explosive device 40 at which the air pressure/velocity are measured, and the environmental conditions such as ambient air pressure, relative humidity level and other parameters. The overpressure wave 42 may travel along a first direction 44 generally toward the underside 24 of the vehicle 12.

The system 50 includes the blast diffuser 52 which may extend along a length of the vehicle 12 such as along the passenger compartment 26 or any portion thereof. The blast diffuser 52 may also be mounted to the vehicle 12 at locations other than the underside 24 of the vehicle 12 or in addition to the underside 24 of the vehicle 12. For example, the blast diffuser 52 may be mounted to portions of the engine compartment (not shown), the drive train (not shown), the cargo area (not shown) or any other portion of the vehicle 12 that may be susceptible to damage from an overpressure wave 42. In addition, the blast diffuser 52 may be mounted to the sides of the vehicle 12 and/or to the top surfaces of the vehicle 12 or to equipment and/or cargo that may be carried by the vehicle 12. In this regard, the present disclosure contemplates installation of the blast diffuser 52 on any structure 10, without limitation, including any vehicular or non-vehicular structure 10. For example, the blast diffuser 52 may optionally be installed on the sides of buildings (not shown) to protect the building against impact from an overpressure wave. The blast diffuser 52 may also be installed on other types of structure including, without limitation, a dam, a tunnel and a bridge or any other structure. However, in the present disclosure, the blast diffuser 52 is described in the context of protecting the underside 24 of a vehicle 12.

As shown in FIG. 1, the blast diffuser 52 may include a plurality of vanes 64 for preventing direct impact of the overpressure wave 42 against the underside 24 of the vehicle 12. In this regard, the blast diffuser 52 may deflect or redirect an overpressure wave 42 generated by the explosive device 40. The vanes 64 may be spaced apart from one another and are preferably oriented in non-perpendicular (i.e., non-vertical) relation to the underside 24 of the vehicle 12. The airflow 82 of the overpressure wave 42 may enter the spacings between the vanes 64. The vanes 64 may define an entrance 56 to the blast diffuser 52. The vanes 64 may redirect the overpressure wave 42 from the first direction 44 to a second direction 46 generally along the side of the vehicle 12. The vanes 64 may be offset from the underside 24 such that a gap 80 is formed between the vane 64 edges and the underside 24 of the vehicle 12. The airflow 82 of the overpressure wave 42 may pass along the gap 80 in the second direction 46 and may be discharged at an exit 58 of the blast diffuser 52 at one end 62 of the blast diffuser 52 or at opposite ends 62 of the blast diffuser 52. In this manner, direct impact of the overpressure wave 42 against the vehicle 12 is avoided.

Figure 2:
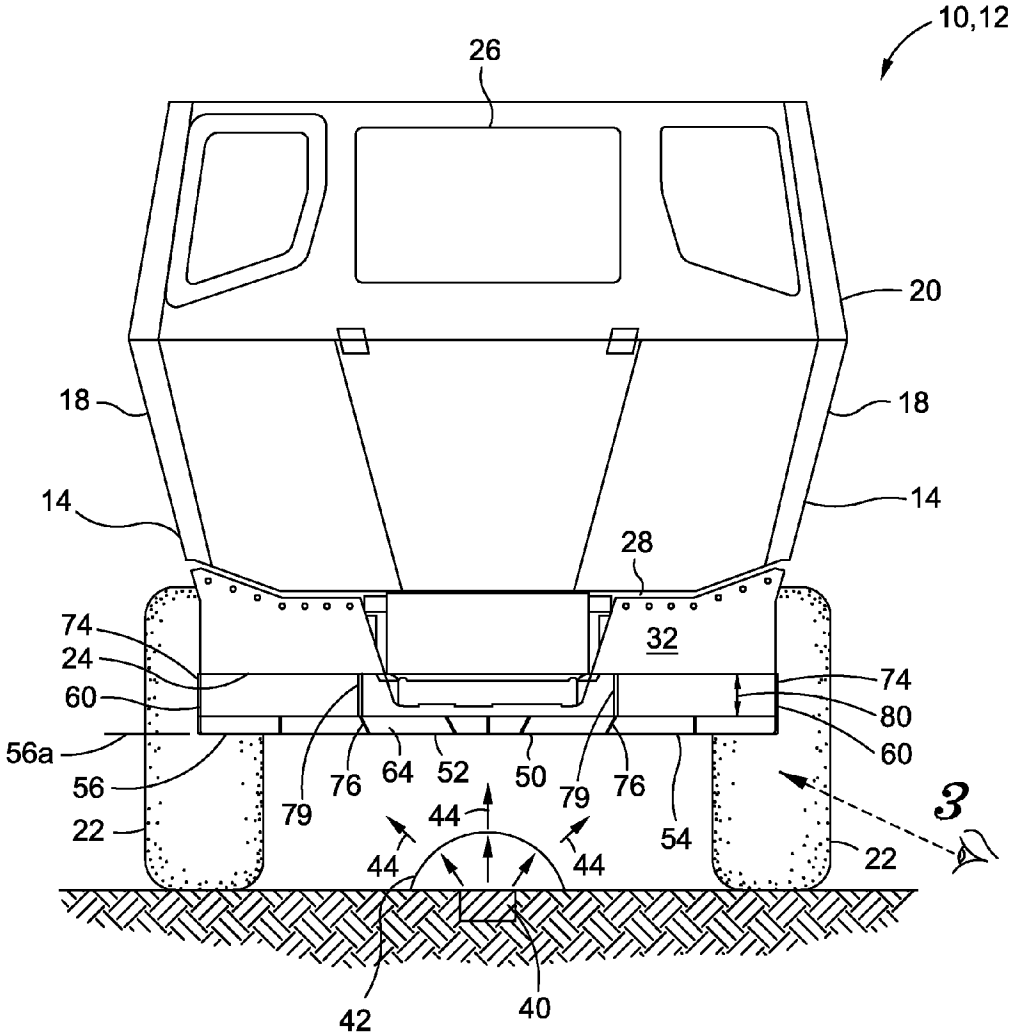
FIG. 2 is a view of the vehicle taken along line 2 of FIG. 1 and illustrating the blast diffuser mounted to the vehicle underside.

FIG. 2 is an aft view of the vehicle 12 and illustrating the blast diffuser 52 mounted to the vehicle 12 underside 24. The vehicle 12 includes opposing vehicle sides 18 which may define the perimeter 14 of the vehicle 12. The blast diffuser 52 may span the width of the vehicle 12 although the blast diffuser 52 may extend across any portion of the width of the vehicle 12. For example, the blast diffuser 52 may extend across a width of the passenger compartment 26 or any portion thereof for protection of the occupants 30. The vanes 64 may be mounted in offset relation to a blast plate 32 that may optionally be mounted to the underside 24 of the vehicle 12. The blast plate 32 may be configured to facilitate airflow 82 (FIG. 1) along the underside 24 of the vehicle 12. The blast plate 32 may be generally planar and/or the blast plate 32 may include contours that approximate the shape of the vehicle 12 underside 24. In this regard, the contoured blast plate 32 may close off air pockets, nooks or crannies in the underside 24 of the vehicle 12 to facilitate airflow 82 (FIG. 1) along the underside 24.

FIG. 2 also illustrates a pair of support brackets 74 for mounting the blast diffuser 52 to the vehicle 12. The support bracket 74 may be positioned in spaced relation to one another. The vanes 64 may extend between the pair of support brackets 74. Although a pair of the support brackets 74 are shown, the blast diffuser 52 may include any number of support brackets 74 for attaching the vanes 64 to the vehicle 12. The vanes 64 may have opposing vane ends 66 that may be welded and/or mechanically fastened to the support brackets 74. Although each one of the vanes 64 is shown as continuous or unitary component extending between the support brackets 74, the vanes 64 may be comprised of vane segments (not shown) which may be connected to one another.

Figure 3:
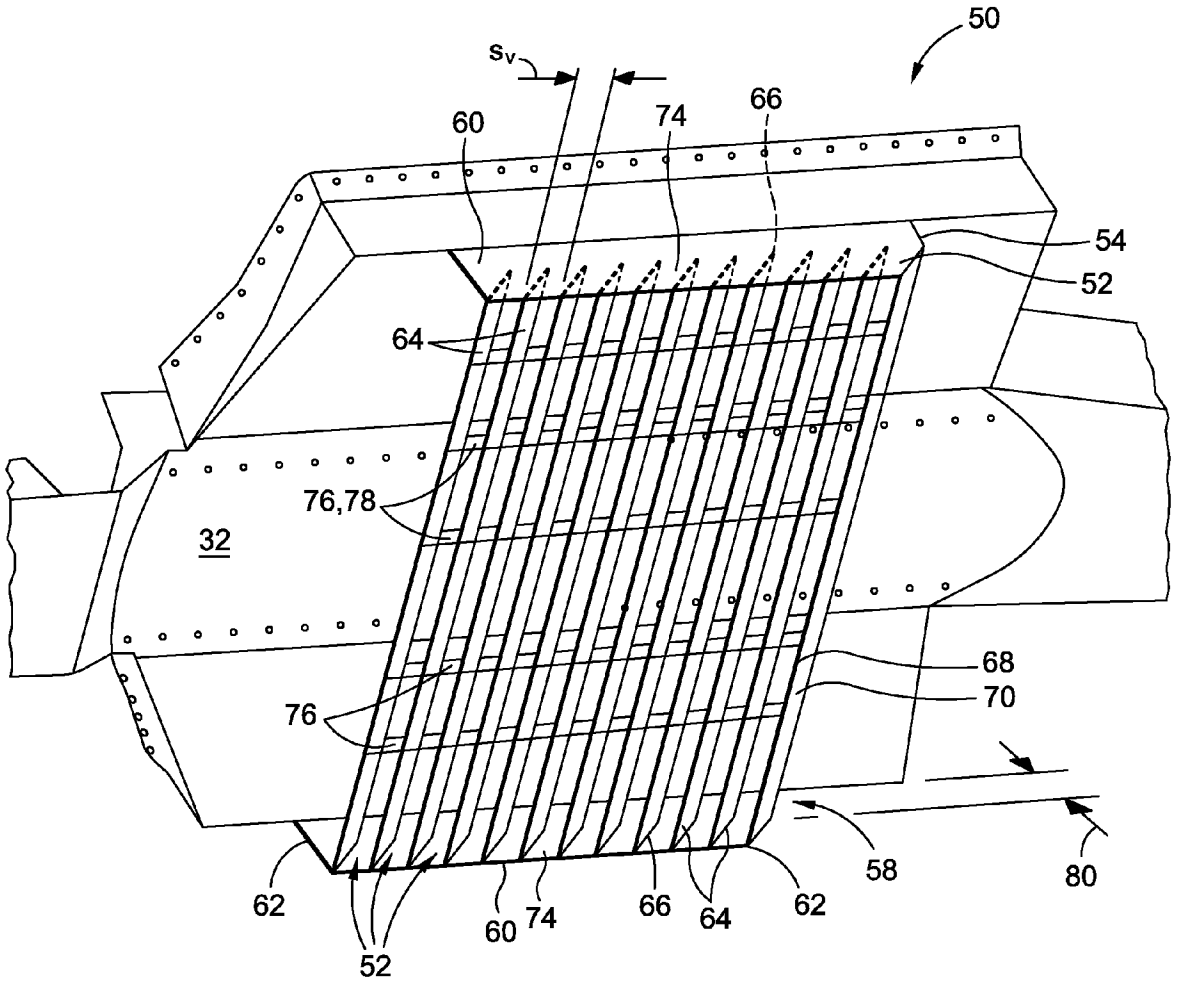
FIG. 3 is a bottom perspective view of the blast diffuser mounted to a blast plate on the vehicle underside.

FIG. 3 is a perspective view of the blast diffuser 52 mounted to a blast plate 32. The blast plate 32 may be formed of high modulus material including, but not limited to, high modulus and/or high strength steel, titanium, or any other metallic material. The blast plate 32 may optionally be formed of composite material including, but not limited to, fiber-reinforced polymeric material. The blast plate 32 may also be formed of a combination of metallic and composite material. The blast plate 32 may assist in the airflow 82 (FIG. 1) flowing along the gap 80 (FIG. 1) toward the exit(s) 58 (FIG. 1) of the blast diffuser 52. The blast plate 32 may also minimize or prevent penetration of the passenger compartment 26 by projectiles and/or shrapnel that may be ejected by the explosive device 40.

The blast diffuser 52 as illustrated in FIG. 3 may be comprise an assembly 54 including the vanes 64, support brackets, and/or blast plate 32. The assembly 54 may have assembly ends 62 and assembly sides 60. The support brackets 74 may be located on the assembly sides 60 and may have a planar shape although non-planar shapes are contemplated. A pair of the support brackets 74 may extend along the vehicle sides 18 (FIG. 1) and may be attached to the vehicle 12 (FIG. 1) by welding, mechanical fasteners, or other suitable means for fixedly securing the diffuser assembly 54 to the vehicle 12. The support brackets 74 may be fabricated of high strength and/or high modulus material including, but not limited to, high-strength steel or hardened steel although the support brackets 74 may be fabricated of any metallic material. The support brackets 74 may also be fabricated of composite material or a combination of metallic material and composite material. The vanes 64 of the blast diffuser 52 may extend between the support brackets 74. The vanes 64 may be oriented generally parallel to one another and may be spaced apart from one another at a substantially uniform spacing $s_v$ between adjacent pairs of vanes 64 although the vanes may be arranged with non-uniform spacings $s_v$. Even further, the spacing $s_v$ between any pair of adjacent vanes 64 may be non-uniform along the length of the pair of vanes 64.

In an embodiment, the vanes 64 may extend between the support brackets 74 such that the vanes 64 may be unattached to the underside 24 of the vehicle 12 at points between the support brackets 74. By omitting attachments of the vanes 64 to the vehicle 12 at points between the support brackets 74, impact loads of the overpressure wave 42 against the vanes 64 may be distributed to the support brackets 74 and into the vehicle sides 18. In addition, the unattached vanes 64 may facilitate a desired amount of deflection of the vanes 64 in response to impact of the overpressure wave 42 on the vanes 64. The deflection of the vanes 64 may absorb a portion of the energy of the overpressure wave 42 which may reduce the magnitude of the air pressure of the overpressure wave 42 and/or the velocity of the overpressure wave 42.

Although FIG. 3 illustrates the support brackets 74 attached to the blast plate 32, the present disclosure contemplates attachment of the support brackets 74 to the vehicle (FIG. 1). Furthermore, although a pair of parallel support brackets 74 are shown each having a planar configuration, the support brackets 74 may be provided in any size, shape, orientation, quantity and configuration. Preferably, the vanes 64 are mounted to the support brackets 74 in a manner that minimizes or prevents direct impact of the overpressure wave 42 to vulnerable areas of the structure 10. For example, if the blast diffuser 52 is mounted directly to the vehicle underside 24 without a blast plate 32, the vanes 64 may prevent direct impact of the overpressure wave 42 on the vehicle underside 24 such as against the floor 28 of the passenger compartment 26. By minimizing or preventing direct transmission of the impact of the overpressure wave 42 to the vehicle 12 floor 28, sudden violent movement of the floor 28 may be minimized or prevented which may increase the survivability of the occupants 30 of the passenger compartment 26. In addition, minimizing or preventing direct transmission of the overpressure wave 42 to the vehicle 12 floor 28 may minimize the generation of an overpressure wave 42 within the passenger compartment 26 which may otherwise result from relatively rapid movement of the floor 28. If the blast plate 32 is mounted to the vehicle underside 24 and the blast diffuser 52 is mounted over the blast plate 32, the vanes 64 and blast diffuser 32 may cooperate to prevent direct impact of the overpressure wave 42 on the vehicle underside 24.

Referring still to FIG. 3, the diffuser assembly 54 may optionally include one or more braces 76 mounted between one or more pairs of the vanes 64. In this regard, one or more of the adjacent pairs of vanes 64 may be interconnected by one or more braces 76 to increase the bending stiffness of the vanes 64 by distributing localized loads on the vanes 64 to a plurality of the vanes 64. Such localized loads on the vanes 64 may result from application of the overpressure wave 42 on a localized area (e.g., a center) of the blast diffuser 52. The vanes 64 and braces 76 may be interconnected by welding and/or by mechanical attachment. In an embodiment, one or more of the vanes 64 and braces 76 may be formed as a unitary structure such as by casting and/or by machining the vanes 64 and braces 76 as a grid from solid plate stock or from a casting. The braces 76 may also comprise brace segments 78 extending between one or more adjacent pairs of vanes 64. The brace segments 78 may be aligned with one another as shown in FIG. 3 or the brace segments 78 may be offset (not shown) from one another.

The braces 76 and/or brace segments 78 may optionally be directly connected to the vehicle 12 such as to the underside 24 and/or to the blast plate 32 by means of one or more connectors 79 (FIG. 2). For example, the braces 76 and/or brace segments 78 may be mechanically fastened or connected to the underside 24 and/or to the blast plate 32 by means of one or more connectors 79 (FIG. 2) which may be configured as struts, fittings, brackets, or other attachment means. Although not shown, one or more of the vanes 64 may also be directly connected to the vehicle underside 24 and/or blast plate 32 by means of one or more connectors 79 similar to the configuration shown in FIG. 2 for attaching the braces 76 to the blast plate 32. By locally connecting or attaching one or more of the braces 76, brace segments 78, or vanes 64 to the underside 24 or blast plate 32 at points between the support brackets 74, the structural integrity of the vanes 64 may be improved.

Figure 4:
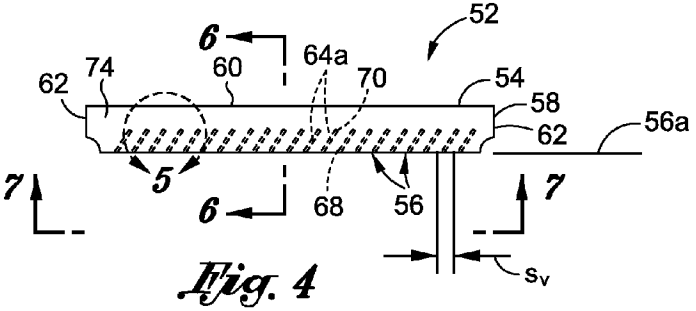
FIG. 4 is a side view of an embodiment of the blast diffuser having planar vanes oriented in a common direction.
Figure 14:
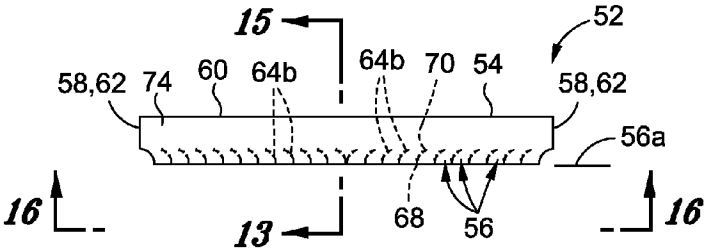
FIG. 14 is a side view of a further embodiment of the blast diffuser having curved vanes oriented in a opposite directions.

FIG. 4 is a side view of an embodiment of the diffuser assembly 54 wherein the vanes 64*a* are provided with a planar configuration. The planar vanes 64*a* may be positioned in spaced parallel relation to one another to allow the passage of the overpressure wave 42 between the planar vanes 64*a*. Although the planar vanes 64*a* are illustrated as being substantially uniformly spaced apart from one another, the planar vanes 64*a* may be positioned at non-uniform spacings $s_v$. Furthermore, the spacing $s_v$ between an adjacent pair of planar vanes 64*a* may be non-uniform along the length of the planar vanes 64*a*. One or more of the planar vanes 64*a* may be oriented in angled relation to the entrance plane 56*a* of the diffuser assembly 54. In an embodiment, the planar vanes 64*a* may be oriented at substantially the same angle relative to the entrance plane 56*a* such that the planar vanes 64*a* face toward one of opposing assembly ends 62 of the diffuser assembly 54. In such an arrangement, the redirected airflow 82 (FIG. 1) may flow toward an exit 58 of the diffuser assembly 54 at one of the assembly ends 62. However, it is contemplated that the planar vanes 64*a* may be oriented such that the airflow 82 (FIG. 1) may be directed in opposite directions (FIG. 14) toward opposite ones of the assembly ends 62 (FIG. 14).

Figure 5:
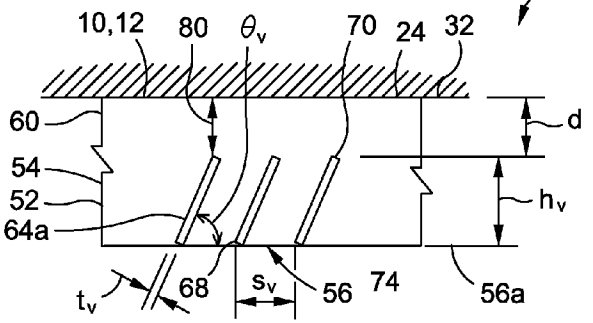
FIG. 5 is an enlarged side view of the vanes taken along line 5 of FIG. 4 and illustrating a gap between the vanes and the vehicle underside.

FIG. 5 is an enlarged side view of a portion of one of the support brackets 74 and several of the planar vanes 64*a* of the diffuser assembly 54. The planar vanes 64*a* may be oriented at a non-perpendicular vane angle $\theta_v$ relative to the entrance plane 56*a* of the diffuser assembly 54. The vane angle $\theta_v$ may range from approximately 10 degrees to approximately 80 degrees relative to the entrance plane 56*a* although angles $\theta_v$ outside of the 10-80 degree range are contemplated. For example, one or more of the planar vanes 64*a* may be oriented approximately perpendicularly relative to the entrance plane 56*a*. In a preferred embodiment, one or more of the planar vanes 64*a* may be oriented at a vane angle $\theta_v$ of between approximately 35 degrees and 65 degrees relative to the entrance plane 56*a*. The planar vanes 64*a* may be oriented at a vane angle $\theta_v$ that redirects the overpressure wave 42 (FIG. 1) from the first direction 44 (FIG. 1) to a second direction 46 (FIG. 1) generally parallel to a side of the structure 10 (FIG. 1).

The vanes 64*a* may be spaced apart from one another at a vane spacing $s_v$ that prevents direct impingement of the overpressure wave 42 against the structure 10. In this regard, the vane spacing $s_v$ may be such that the leading edge 68 of each planar vane 64*a* overlaps the trailing edge 70 of an adjacent planar vane 64*a* when viewed along a direction approximately perpendicular to the entrance plane 56*a*. In such an overlapping arrangement, direct line-of-sight of the structure 10 may be prevented. However, the vane spacing $s_v$ may be varied such that the vanes 64*a* overlap one another in one area of the diffuser assembly 54 and do not overlap one another in other areas of the diffuser assembly 54. In an embodiment, the vane spacing $s_v$ may range from between approximately 0.5 inch to 10 inches although spacing outside of the 0.5 to 10 inch range are contemplated. The vane spacing $s_v$ may be selected based upon the vane angle $\theta_v$ and the cross-sectional geometry of the vanes 64*a*. For example, the vanes 64*a* may have a relatively thin vane thickness $t_v$ and a relatively short vane height $h_v$ that may dictate a relatively short vane spacing $s_v$ to provide for overlapping of the vanes 64*a*. Conversely, vanes 64*a* of relatively large thickness $t_v$ and relatively large vane height k may permit a larger vane spacing $s_v$ that provides overlapping of the vanes 64*a*.

In a non-limiting embodiment, the vanes 64*a* may have a height $h_v$ measured approximately perpendicularly relative to the entrance plane 56*a* and extending from the leading edge 68 to the trailing edge 70 of the vane 64*a*. The vane height $h_v$ may be between approximately 0.25 inch and 24 inches and, more preferably, between approximately 4 inches and 8 inches. The vanes 64*a* may be provided in a thickness $t_v$ that minimizes deflection or deformation of the vanes 64*a* under impact from the overpressure wave 42. The thickness $t_v$ of the vanes 64*a* may be based upon the air pressure and velocity of the overpressure wave 42 (FIG. 1). In addition, the thickness $t_v$ of the vanes 64*a* may also be based upon the distance of the vanes 64*a* from the explosive device 40 (FIG. 1), the orientation of the vane angle $\theta_v$, and the mechanical properties (e.g., tensile modulus, ultimate strength) of the vane 64*a* material.

In a non-limiting embodiment, the vanes 64*a* may have a thickness $t_v$ of between approximately 0.10 and 2.00 inches although smaller or larger thicknesses are contemplated. The vanes 64*a* may preferably be formed of high modulus and/or high stiffness metallic material and/or fiber-reinforced polymeric material to resist excessive deformation that may otherwise result in the vanes 64*a* contacting the vehicle 12 structure 10 at locations between the support brackets 74. In a non-limiting embodiment, the metallic material may be formed of hardened steel, high-strength steel, steel alloy, titanium, titanium alloy, or other metallic compounds or alloys. Vanes 64*a* may also be fabricated of fiber-reinforced polymeric material and may include carbon fibers, graphite fibers, boron fibers or other fiber materials having relatively high tensile moduli. In a non-limiting embodiment, the fibers may have a tensile modulus that increases with strain rate such that resistance to vane 64*a* bending increases with increasing magnitudes of air pressure and velocity of the overpressure wave 42 (FIG. 1).

Referring still to FIG. 5, the vanes 64*a* may be offset from the vehicle 12 underside 24 (i.e., the structure 10) by an offset distance d such that a gap 80 is formed between the vanes 64*a* and the structure 10 to allow for airflow 82 (FIG. 1) between the vanes 64 and the structure 10. The gap 80 may be defined as the distance between the trailing edge 70 of the vanes 64*a* and the vehicle 12 underside 24 or blast plate 32 if included with the system 50. The gap 80 may be sized to provide sufficient area between the vane leading edges 68 and the structure 10 or blast plate 32 to allow the airflow 82 (FIG. 1) from the overpressure wave 42 (FIG. 1) to flow unimpeded toward the exit 58 (FIG. 1) of the diffuser assembly 54. In an embodiment, the gap 80 may be at least approximately 0.25 inch and may be as large as 5 inches or larger. The gap 80 may be substantially constant or uniform along a length of the diffuser assembly 54. However, the gap 80 between the vane trailing edges 70 and the structure 10 may vary along the length of the diffuser assembly 54. For example, the gap 80 may progressively increase in height along a direction from one end 58 (FIG. 4) of the diffuser assembly 54 toward an opposite end 58 (FIG. 4) of the diffuser assembly 54. The progressive increase in the gap 80 may accommodate contributions to the airflow 82 from each set of vanes 64*a* as the airflow 82 (FIG. 1) moves along the gap 80 toward the exit 58 (FIG. 4) of the diffuser assembly 54.

Figure 6:
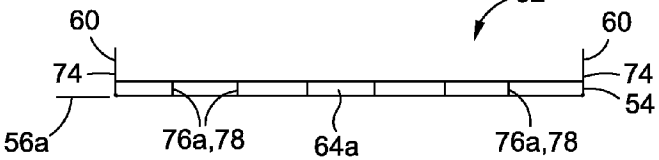
FIG. 6 is a front view of the embodiment of the blast diffuser taken along line 6 of FIG. 4 and illustrating the planar vanes extending between a pair of support brackets on opposite sides of the blast diffuser.

FIG. 6 is a section view of the diffuser assembly 54 showing the vanes 64*a* extending between the support brackets 74 located at the sides 60 of the diffuser assembly 54. A plurality of braces 76*a* may be interconnected to the vanes 64*a* to improve the strength and/or stiffness of the diffuser assembly 54. The braces 76*a* are illustrated as having a generally planar configuration 76*a* and are shown as being generally uniformly spaced apart from one another across a width of the diffuser assembly 54. However, the braces 76*a* may be provided in a non-planar configuration or a curved configuration 76*b* (FIG. 11) as described in greater detail below. The braces 76*a* may also be non-uniformly spaced (FIG. 12). For example, as shown in FIG. 12, the braces 76*a* may have a narrow brace spacing $s_b$ at a general center of the width of the diffuser assembly 54 and a wider brace spacing $s_b$ toward the sides 60 of the diffuser assembly 54. In FIG. 6, the braces 76*a* are shown as being oriented generally perpendicularly relative to the entrance plane 56*a*. However, the braces 76*a* may be oriented in non-perpendicular relation to the entrance plane 56*a* to redirect the overpressure blast 42 (FIG. 1) away from a central portion of the structure 10 (FIG. 1).

Figure 7:
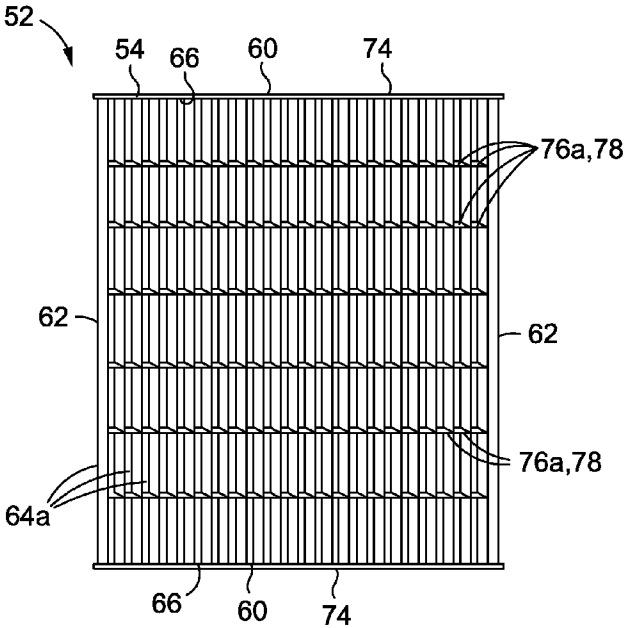
FIG. 7 is a bottom view of the embodiment of the blast diffuser taken along line 7 of FIG. 4 and illustrating a plurality of braces oriented approximately perpendicularly relative to the planar vanes.

FIG. 7 is a bottom view of the diffuser assembly 54 illustrating the braces 76 oriented generally perpendicular to the vanes 64. However, as was earlier indicated, the braces 76 may be oriented at any angle relative to the vanes 64. For example, the braces 76 may be oriented in non-perpendicular relation to the vanes 64. FIG. 7 also illustrates the vanes 64 oriented generally perpendicularly relative to the support brackets 74. However, the vanes 64 may be oriented at non-perpendicular angles relative to the support brackets 74.

Figure 8:
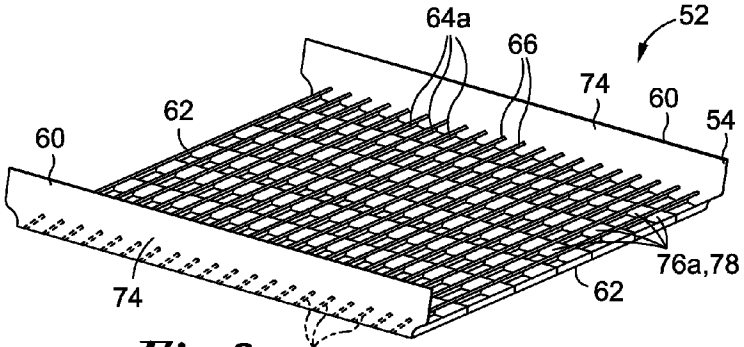
FIG. 8 is a top perspective illustration of the blast diffuser of FIG. 7.

FIG. 8 is a perspective view of the diffuser assembly 54 showing the planar vanes 64*a* extending between the parallel support brackets 74. The vanes 64*a* may be interconnected by the braces 76*a*. As was earlier indicated, the vanes 64*a* and braces 76*a* may be interconnected by welding, by mechanical attachment, or the vanes 64*a* and one or more of the braces 76*a* may be formed as a unitary structure. Further in this regard, it is contemplated that one or more of the support brackets 74 and one or more of the vanes 64*a* may be formed as a unitary structure.

Figure 9:
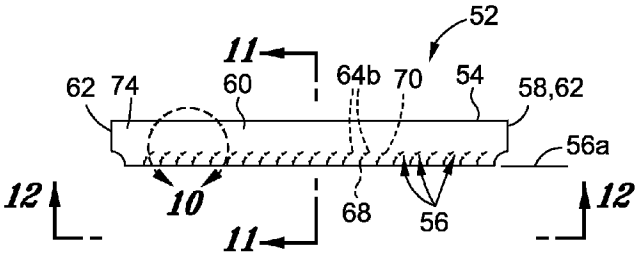
FIG. 9 is a side view of a further embodiment of the blast diffuser having curved vanes oriented in a common direction.

FIG. 9 is a side view of a further embodiment of the diffuser assembly 54 having curved vanes 64*b* oriented in a common direction toward one of the ends 62 of the diffuser assembly 54. The curved vanes 64*b* may be shaped and configured to change the direction of the overpressure wave 42 from the first direction 44 (FIG. 1) to the second direction 46 (FIG. 1) such that the airflow 82 (FIG. 1) may flow toward an exit 58 of the diffuser assembly 54 at one of the assembly ends 62. The support brackets 74 and curved vanes 64*b* may be configured in a manner similar to that which is described above for the planar vane 64*a* embodiment shown in FIG. 4.

Figure 10:
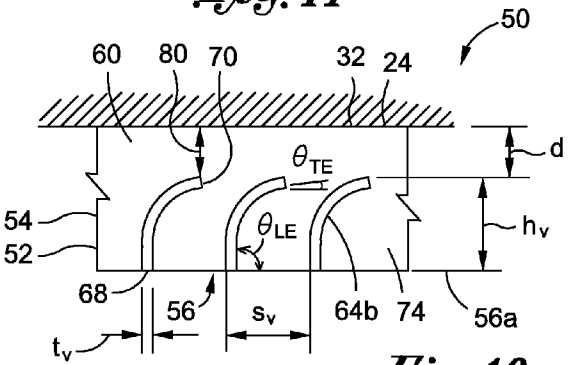
FIG. 10 is an enlarged side view of the vanes taken along line 10 of FIG. 9 and illustrating a gap between the vanes and the vehicle underside.

FIG. 10 is an enlarged side view of a portion of one of the support brackets 74 and several of the curved vanes 64*b* of the diffuser assembly 54 of FIG. 9. Each one of the vanes 64*b* may have a leading edge 68 at the entrance plane 56*a* and a trailing edge 70 on an opposite side of the same vane 64*b*. The leading edges 68 of the vanes 64*b* may define the entrance plane 56*a* of the diffuser assembly 54. The vane leading edges 68 may be oriented at a leading edge angle $\theta_{LE}$ (i.e., at the tangent point of the leading edge 68) measured relative to the entrance plane 56*a*. Likewise, the vane trailing edges 70 may be oriented at a trailing edge angle $\theta_{TE}$ measured relative to the entrance plane 56*a*. The leading edge angle $\theta_{LE}$ may be different than the trailing edge angle $\theta_{TE}$. For example, in an embodiment, the leading edge 68 of a curved vane 64*b* may be oriented at an angle $\theta_{LE}$ of approximately 90 degrees (i.e., perpendicular) to the entrance plane 56*a* while the vane trailing edge 70 of the same curved vane 64*b* may be oriented at an angle $\theta_{TE}$ other than 90 degrees to the entrance plane 56*a*. The leading edge 68 of the curved vanes 64*b* may optionally be oriented at an angle $\theta_{LE}$ other than 90 degrees to the entrance plane 56*a*. For example, the leading edge 68 of the curved vanes 64*b* may be oriented at an acute angle. In an embodiment, the leading edge 68 of one or more of the curved vanes 64*b* may be oriented at a leading edge angle $\theta_{LE}$ of between approximately 60 to 90 degrees. Likewise, the trailing edge 70 (i.e., at the tangent point thereof) may also be oriented at an acute angle to redirecting the overpressure wave 42 (FIG. 1) toward the second direction 46 (FIG. 1). For example, the trailing edge 70 may be oriented at an angle $\theta_{TE}$ of between approximately 35 degrees and 65 degrees relative to the entrance plane 56*a* (FIG. 5) although the vanes 64*a* may be oriented at vane angles $\theta_v$ outside of the 35-65 degree range.

The curved vanes 64*b* may have a vane thickness $t_v$, a vane height $h_v$ and a vane spacing $s_v$ as was described above for the planar vane 64*a* embodiment illustrated in FIG. 4. The curved vane 64*b* thickness $t_v$, vane height $h_v$ and vane spacing $s_v$ may be such that the leading edge 68 of each curved vane 64*b* overlaps the trailing edge 70 of the adjacent curved vane 64*b* to prevent direct line-of-sight to the structure 10 when viewed along a direction approximately perpendicular to the entrance plane 56*a*. However, the vane thickness $t_v$, vane height $h_v$ and vane spacing $s_v$ for any of the embodiments disclosed herein may be similar to that described above for the diffuser assembly 54 illustrated in FIGS. 4-8. The thickness $t_v$ of the curved vanes 64*b* may be less than thickness $t_v$ of planar vanes 64*a* (FIG. 5) due to the inherent stiffness provided by the curvature of the curved vanes 64*b*. The vanes 64*b* may be offset from the structure 10 by an offset distance d such that a gap 80 if formed between the vanes 64*b* and the structure 10 for airflow 82 (FIG. 1) between the vanes 64 and the structure 10.

Figure 11:
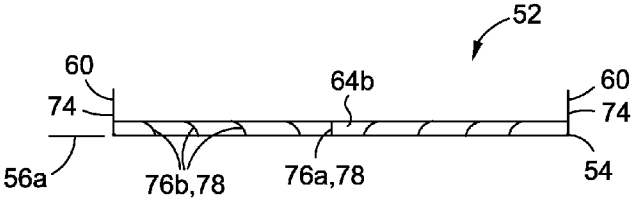
FIG. 11 is a front view of the embodiment of the blast diffuser taken along line 11 of FIG. 9 and illustrating the curved vanes extending between the pair of support brackets.
Figure 12:
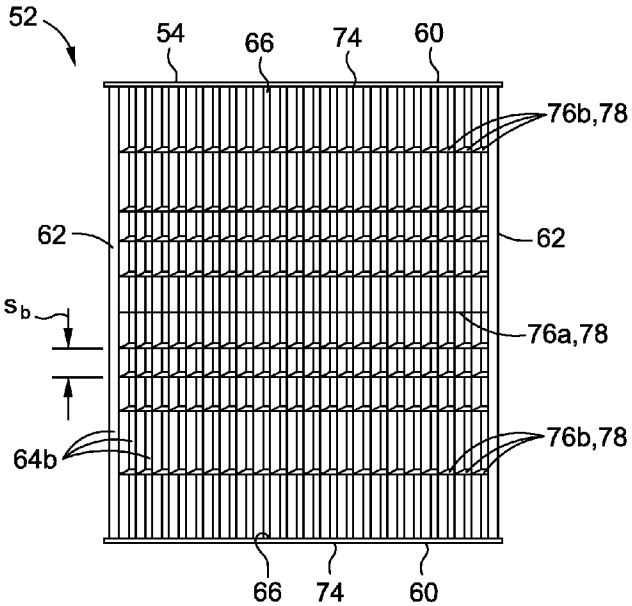
FIG. 12 is a bottom view of the embodiment of the blast diffuser taken along line 12 of FIG. 9 and illustrating the braces oriented approximately perpendicularly relative to the curved vanes.

FIG. 11 is a section view of the diffuser assembly 54 illustrating the braces having a planar configuration 76*a* and a curved configuration 76*b*. The brace with the planar configuration 76*a* is positioned at the approximate center of the width of the diffuser assembly 54. The remaining braces on each side of the center brace 76*a* have a curved configuration 76*b* to redirect the overpressure wave 42 in opposite directions away from the center area of the structure 10 to which the diffuser assembly 54 may be mounted.

FIG. 12 is a bottom view of the diffuser assembly 54 illustrating a non-uniform spacing $s_b$ of the braces 76*a*, 76*b*. A large quantity of braces 76*a*, 76*b* may be located near the center of the width of the diffuser assembly 54 which may increase the stiffness and/or strength of the vanes 64 near the center of the diffuser assembly 54. In this manner, the braces 76*a*, 76*b* may prevent deflection of the vanes 64*b* when the vanes 64*b* are impacted by the overpressure wave 42 (FIG. 1) and thereby prevent contact of the vanes 64*b* with the structure 10.

Figure 13:
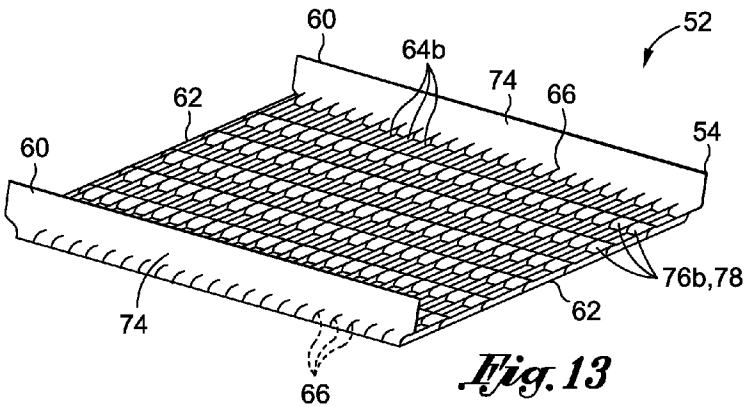
FIG. 13 is a top perspective illustration of the blast diffuser of FIG. 12.

FIG. 13 is a perspective view of the diffuser assembly 54 illustrating the curved vanes 64*b* facing in a common direction toward one of the ends 62 of the diffuser assembly 54. In an embodiment, the diffuser assembly 54 may be mounted to the vehicle 12 (FIG. 1) such that the airflow 82 from the overpressure wave 42 (FIG. 1) is discharged toward the aft end 16*b* (FIG. 1) of the vehicle 12. However, the diffuser assembly may be mounted such that the overpressure wave 42 (FIG. 1) is discharged toward the forward end 16*a* (FIG. 1) of the vehicle 12 or any other direction relative to the vehicle 12.

Figure 15:
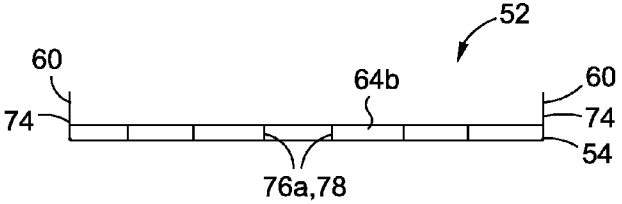
FIG. 15 is a front view of the embodiment of the blast diffuser taken along line 15 of FIG. 14 and illustrating the curved vanes extending between the pair of support brackets.
Figure 17:
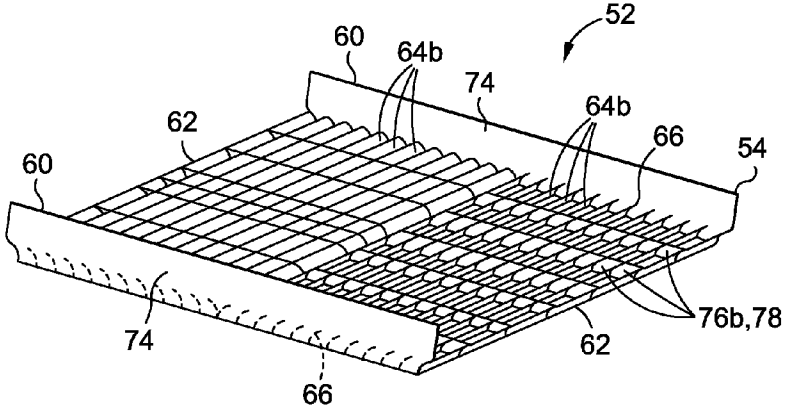
FIG. 17 is a top perspective illustration of the blast diffuser of FIG. 16.
Figure 16:
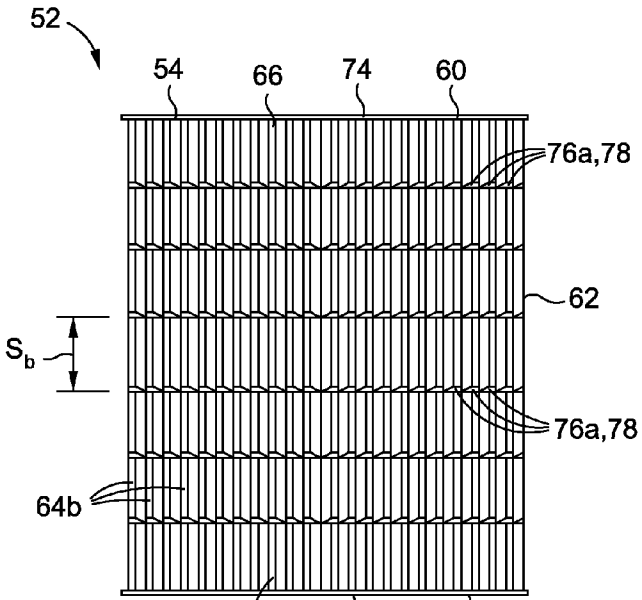
FIG. 16 is a bottom view of the embodiment of the blast diffuser taken along line 16 of FIG. 14 and illustrating the braces oriented approximately perpendicularly relative to the curved vanes.

FIGS. 14-17 illustrate a further embodiment of the diffuser assembly 54 having curved vanes 64*b* oriented in opposite directions. FIG. 14 is a side view of the diffuser assembly 54 illustrating equal quantities of the curved vanes 64*b* facing in opposite directions. The curved vanes 64*b* may be configured to change the direction of the overpressure wave 42 (FIG. 1) from the first direction 44 (FIG. 1) generally toward the vehicle 12 (FIG. 1) to a direction generally parallel to the structure 10 such as along the underside 24 (FIG. 1) of the vehicle 12. FIG. 15 illustrates the braces 76*a* being uniformly spaced across a width of the diffuser assembly 54. FIG. 16 illustrates the braces 76*a* being oriented generally perpendicular relative to the vanes 64*b* although non-perpendicular orientations of the braces 76*a* are contemplated as mentioned above. FIG. 17 illustrates the curved vanes 64*b* facing in opposite directions. Mounting of the diffuser assembly 54 embodiment to a vehicle 12 (FIG. 1) may result in a portion of the airflow 82 (FIG. 1) flowing toward the forward end 16*a* and a portion of the airflow 82 (FIG. 1) flowing toward the aft end 16*b* of the vehicle 12.

Although FIGS. 4-14 illustrate the vanes in a planar 64*a* configuration (FIGS. 1-8) and a curved configuration (FIGS. 9-17), the diffuser assembly may include any combination of curved vanes 64*b* and planar vanes 64*a*. In addition, the diffuser assembly 54 may be configured with vane configurations other than curved vanes 64*b* or planar vanes 64*a*. For example, the vanes may be configured as tubular elements (not shown) that may be mounted to one or more support brackets 74. The tubular vanes may extend between a pair of the support brackets 74. Such tubular elements may have a greater bending stiffness that single-thickness planar vanes 64*a* or curved vanes 64*b* shown in the figures. In a non-limiting embodiment, such tubular elements may have a cylindrical shape (not shown) of any diameter. The cylindrical element may be thin-walled to minimize weight. Other cross-sectional shapes of such tubular elements are contemplated. For example, the tubular elements may be provided in an aerodynamic cross sectional shape (not shown) to improve the airflow redirecting capability of the vanes 64.

Figure 18:
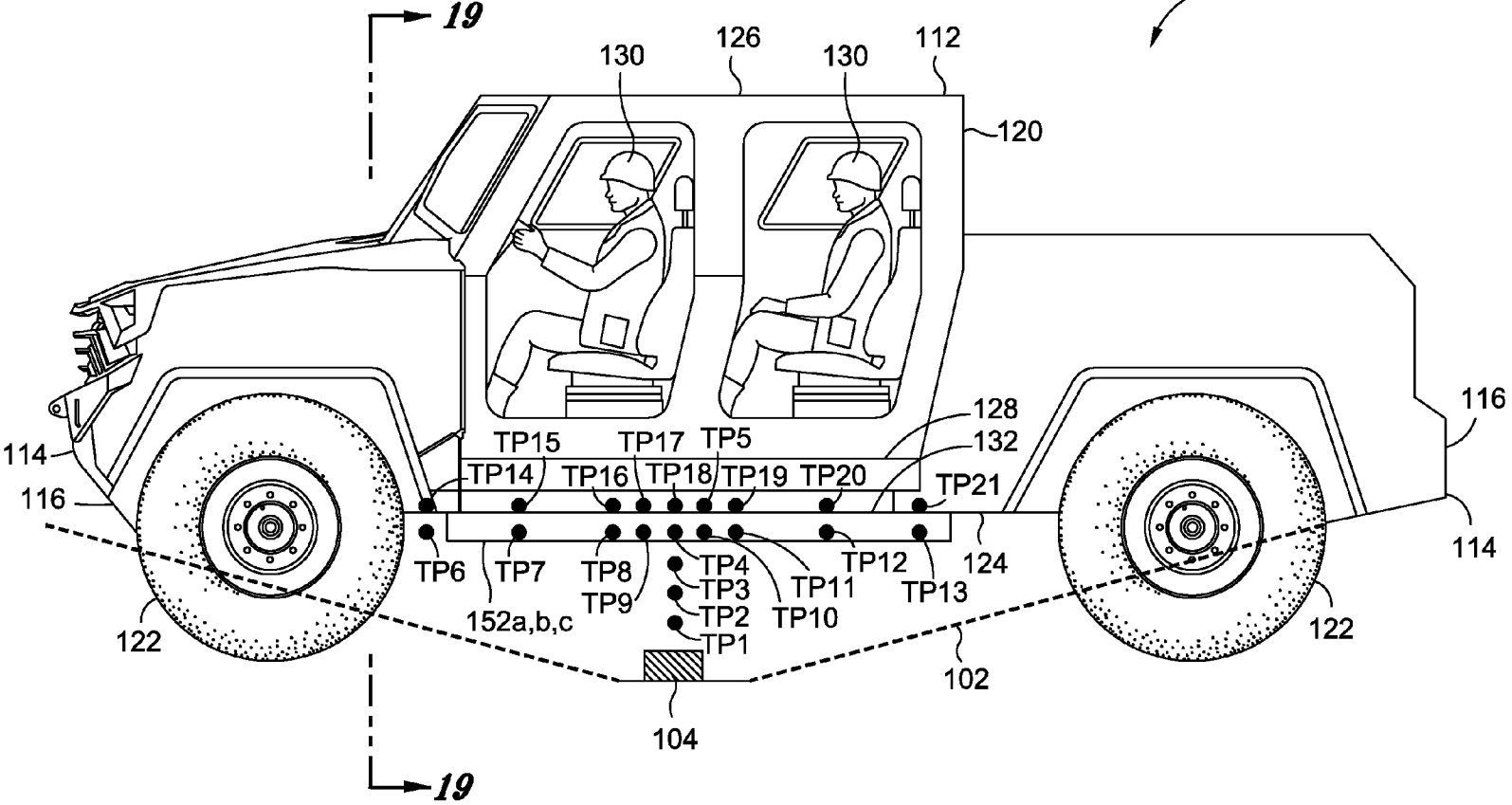
FIG. 18 is a side view of a computer model of the vehicle and the location of an explosive device and a plurality of tracer particles indicating pressure measurement locations.
Figure 19:
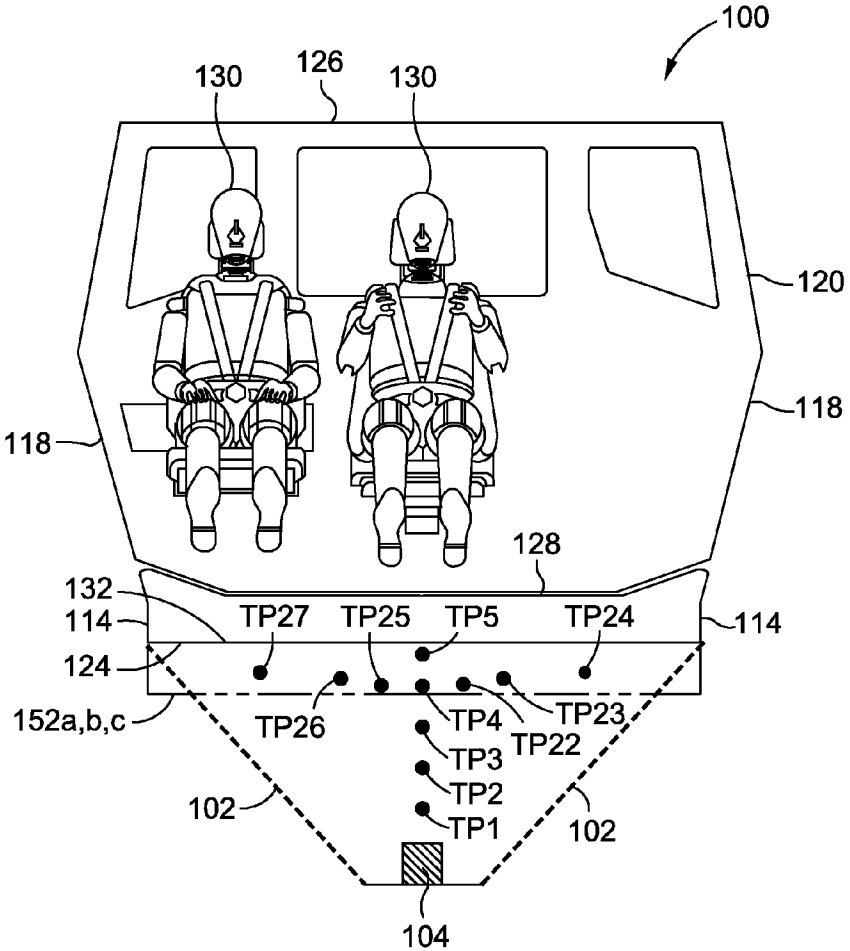
FIG. 19 is a front view of the computer model of the vehicle and illustrating the location of the explosive device and the tracer particles.

FIG. 18 is a side view of a computer model of the vehicle 112 used in a computer simulation 100 for simulating and predicting the dynamic response of the overpressure wave 42 (FIG. 1) and the structural response of the blast diffuser 52 (FIG. 1) during an overpressure event. The overpressure event in the computer simulation 100 simulated an overpressure wave 42 (FIG. 1) as may be generated by an explosion from an explosive device 40 (FIG. 1) such as a landmine. The computer model in the simulation was used to simulate an overpressure wave generated by an explosive device 104 located on a surface under the vehicle 112 passenger compartment 126 and which was generally centered with respect to the length of the blast diffuser 152 and centered with respect to the width of the blast diffuser 152 (FIG. 19). The vehicle 112 in the computer simulation 100 was modeled similar to the vehicle 12 configuration illustrated in FIGS. 1-2. The computer model of the vehicle 112 included wheels 122 and a vehicle body 120 having a passenger compartment 126 housing occupants 130. The vehicle 112 extended between forward and aft ends 116 defining the vehicle perimeter 114. The computer model of the vehicle 112 also included a flat or planar blast plate 132 mounted to the underside 124 of the vehicle 112.

A finite element program was used to simulate the behavior of the overpressure wave 42 (FIG. 1) in an air medium within the analysis area boundary 102 defined by the underside 124 of the vehicle 112 and by the dashed lines extending upwardly from the simulated explosive device 104 toward the vehicle 112 perimeter 114 as illustrated in FIGS. 18-19. The computer simulation 100 included a plurality of tracer particles TP1, TP2 . . . TP27 (FIGS. 18-19) to measure pressure and velocity of the overpressure wave 42 and the dynamic response of a blast diffuser 152 during a series of overpressure events each using a different blast diffuser 152 configuration. FIG. 18 illustrates the location of tracer particles TP1-TP21. Tracer particles TP1-TP5 were spaced vertically between the explosive device 104 and a location adjacent to the blast plate 132. Tracer particles TP6-TP21 were spaced along a length of the blast diffuser 152.

FIG. 19 illustrates the location of tracer particles TP22-TP27 which were spaced across a width of the blast diffuser 152. The blast diffuser configurations analyzed in the computer simulation included a baseline configuration comprising a flat (i.e., planar) blast plate 132 mounted to the vehicle 112 without a blast diffuser. The blast diffuser configurations also included three different configurations of the blast diffuser 152*a*, 152*b*, 152*c* mounted to the vehicle 112 over the flat blast plate 132. The three blast diffuser 152*a*, 152*b*, 152*c* configurations each had curved vanes 64*b* (FIG. 10).

Blast diffuser 152*a* had curved vanes 64*b* (FIG. 10) oriented in a single common direction toward an end 62 (FIG. 10) of the blast diffuser 152*a* similar to the configuration shown in FIGS. 9-13. The curved vanes 64*b* (FIG. 10) of blast diffuser 152*a* had a vane height $h_v$ (FIG. 10) of 2.0 inches and a vane spacing $s_v$ of 2.0 inches. The blast diffuser 152*a* was mounted such that the trailing edges 70 (FIG. 10) of the curved vanes 64*b* were offset from the blast plate 132 by an offset distance d of 3.0 inches.

Blast diffuser 152*b* also had curved vanes 64*b* (FIG. 10) oriented in a single direction similar to the configuration shown in FIGS. 9-13. The curved vanes 64*b* (FIG. 10) of blast diffuser 152*b* had a vane height $h_v$ (FIG. 10) of 3.25 inches and a vane spacing $s_v$ of 4.0 inches. The blast diffuser 152*a* was mounted such that the trailing edges 70 (FIG. 10) of the curved vanes 64*b* were offset from the blast plate 132 by an offset distance d of 2.25 inches.

Blast diffuser 152*c* had curved vanes 64*b* (FIG. 10) oriented in opposite directions similar to the blast diffuser 52 configuration shown in FIGS. 14-17. The curved vanes 64*b* (FIG. 10) had a vane height $h_v$ (FIG. 10) of 4.25 inches and a vane spacing $s_v$ of 4.0 inches. The blast diffuser 152*c* was mounted such that the trailing edges 70 (FIG. 10) of the curved vanes 64*b* were offset from the blast plate 132 by an offset distance d of 2.25 inches. For each one of the blast diffuser configurations 152*a*, 152*b*, 152*c* and for the baseline configuration (i.e., no blast diffuser), the computer simulation was used to simulate the performance of each configuration in response to the same overpressure wave to assess and compare the performance of each configuration.

Figure 20:
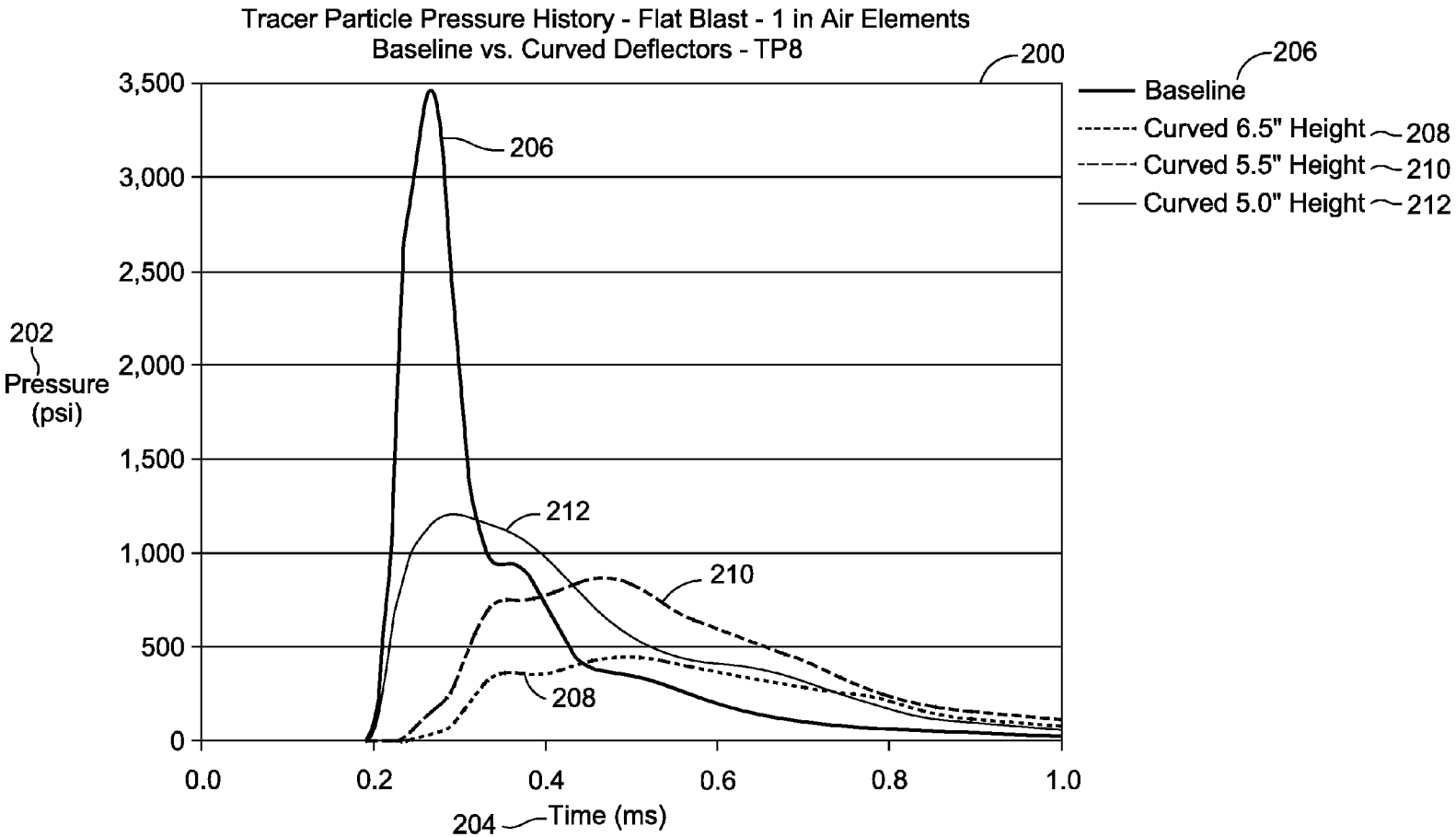
FIG. 20 is a plot of the pressure history of one of the tracer particles for a baseline embodiment of a vehicle having only a blast plate and further illustrating the pressure history for three different embodiments of the blast diffuser mounted to the blast plate.

FIG. 20 is a graph plotting air pressure (pounds per square inch—psi) over time (milliseconds—ms) and illustrating the pressure history of tracer particle TP8 for the baseline configuration and for each one of the three blast diffuser 152*a*, 152*b*, 152*c* configurations (FIG. 18) during a simulated overpressure event. The pressure profile 206 for the baseline configuration illustrates that the peak pressure occurred at approximately 0.2 ms after detonation at a magnitude of approximately 3500 psi. The pressure profile 206 for the baseline configuration also indicates that maximum pressure during the event occurs over a relatively short time period extending from approximately 0.2 to 0.3 ms after detonation. In contrast, for the blast diffuser 152*a* (FIG. 18) with 2.0 inch curved vanes 64*b* (FIG. 10) offset by 3.0 inches, the pressure profile 212 peaked at approximately 1200 psi at an elapsed time of approximately 0.2 ms from detonation with maximum pressure occurring between approximately 0.2 and 0.5 ms after detonation. For the blast diffuser 152*b* (FIG. 18) with 3.25 inch curved vanes 64*b* offset by 2.25 inches, the pressure profile 210 peaked at approximately 800 psi which occurred at an elapsed time of approximately 0.50 ms with maximum pressure occurring between approximately 0.3 and 0.7 ms. Finally, for the blast diffuser 152*c* (FIG. 18) with 4.25 inch curved vanes 64*b* offset by 2.25 inches, the pressure profile 208 peaked at approximately 450 psi and which occurred at an elapsed time of approximately 0.5 ms with the maximum pressures occurring approximately between 0.3 and 0.8 ms from detonation.

Figure 21:
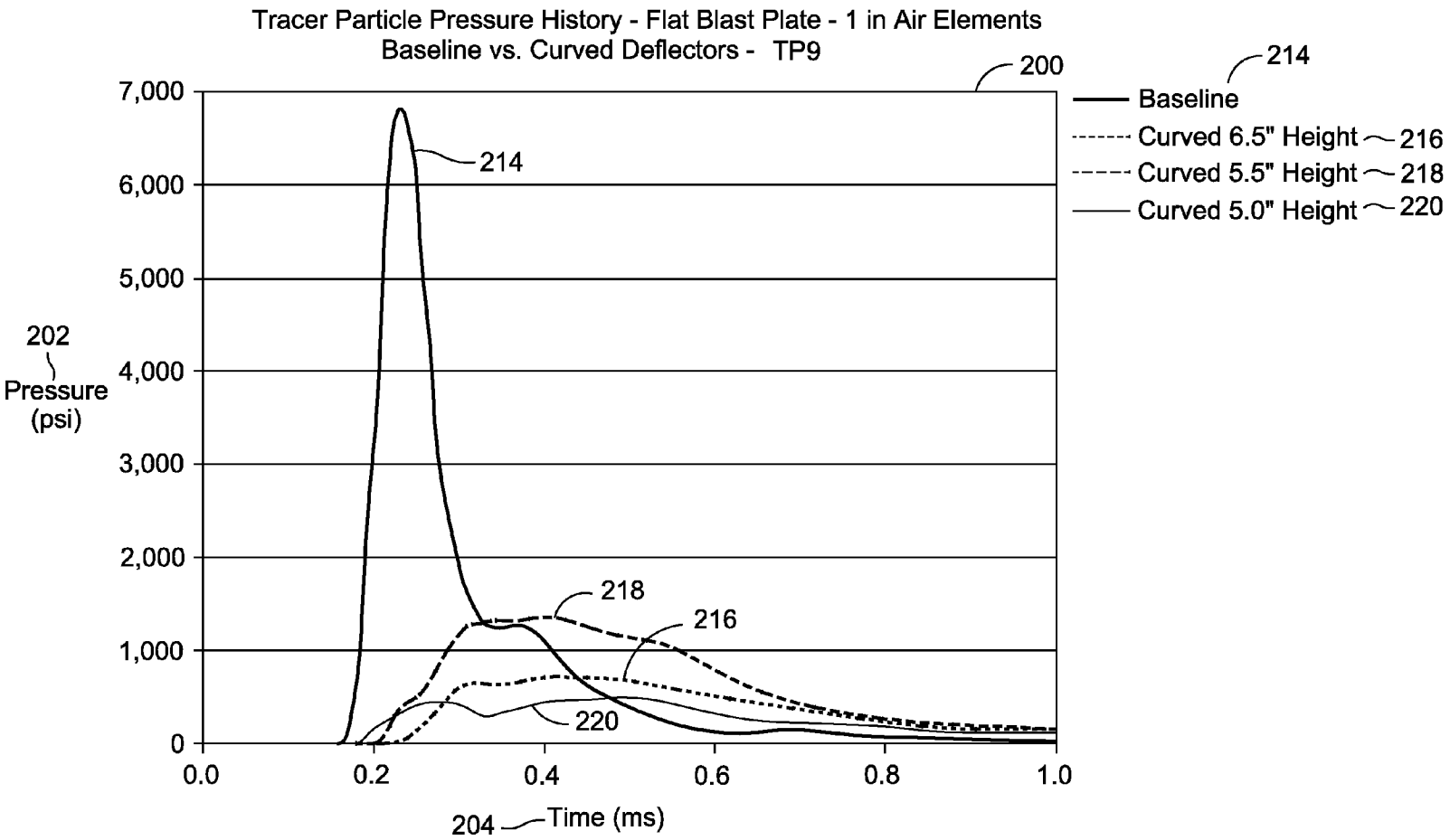
FIG. 21 is a plot of the pressure history of different one of the tracer particles.

FIG. 21 is a graph plotting the pressure history of tracer particle TP9 for the baseline configuration and the three blast diffuser 152*a*, 152*b*, 152*c* (FIG. 18) configurations during the same overpressure event plotted in FIG. 20. The pressure profile 214 for the baseline configuration at tracer particle TC9 illustrates a peak pressure of approximately 6700 psi which is approximately double the peak pressure measured at tracer particle TC8 (FIG. 20) due to the closer proximity of the tracer particle TC9 to the explosive device 104 (FIG. 18). The pressure profiles 216, 218, 220 for the respective blast diffuser 152*a*, 152*b*, 152*c* (FIG. 18) configurations had respective peak pressures of approximately 1200 psi, 800 psi and 500 psi. In this regard, FIGS. 20 and 21 illustrate the effectiveness of the blast diffuser 52 (FIG. 1) in reducing air pressure of an overpressure wave 42 (FIG. 1) by more than a magnitude relative to the air pressure of the overpressure wave at the same location without a blast diffuser.

Figure 22:
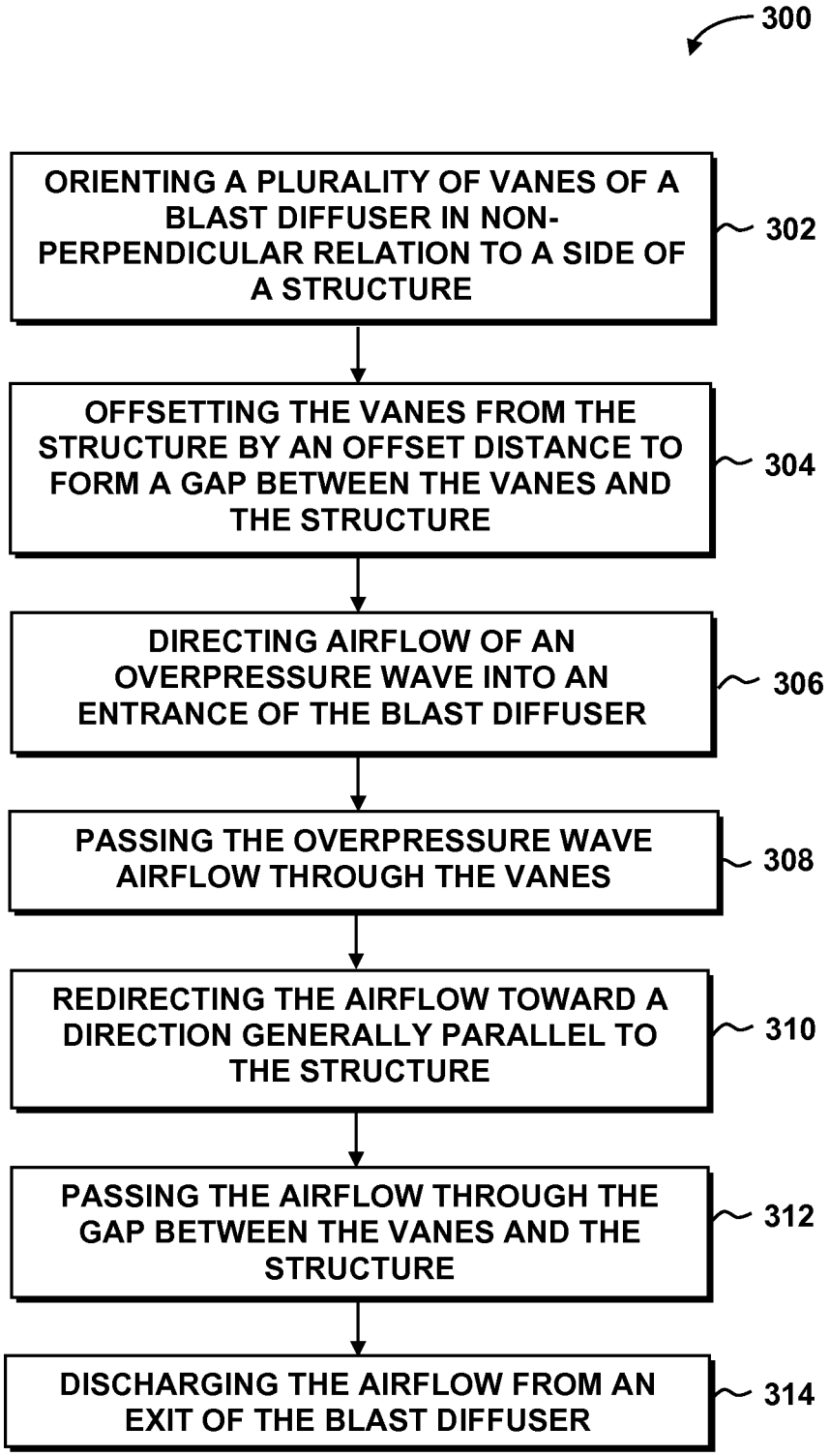
FIG. 22 is a flow chart illustrating a methodology including one or more operations that may be implemented in a system for protecting a structure against an overpressure wave.

FIG. 22 illustrates one or more operations that may be implemented in a methodology 300 for protecting a structure 10 (FIG. 1) such as a vehicle 12 (FIG. 1) passenger compartment 26 (FIG. 1) against an overpressure wave 42 (FIG. 1). The overpressure wave 42 may originate at an explosion that may occur adjacent to the structure 10 such as underneath the vehicle 12 (FIG. 1). The explosion may originate at an explosive device 40 (FIG. 1) such as a landmine buried in a road surface beneath the vehicle 12.

Step 302 of the methodology may comprise orienting the vanes 64 (FIG. 1) in non-perpendicular relation to an entrance plane 56*a* (FIG. 1) of the blast diffuser 52 (FIG. 1). For example, the blast diffuser 52 illustrated in FIG. 1 includes planar vanes 64*a* oriented at a non-perpendicular vane angle $\theta_v$ (FIG. 5) relative to the entrance plane 56*a*. The blast diffuser 52 illustrated in FIG. 9 includes curved vanes 64*b* having leading edges 68 and trailing edges 70 that may be oriented at non-perpendicular leading edge and trailing edge angles $\theta_{LE}$, $\theta_{TE}$ (FIG. 10) respectively. However, the leading edges 68 of the curved vanes 64*b* may be oriented approximately perpendicularly relative to the entrance plane 56*a*.

Step 304 may comprise offsetting the vane trailing edges 70 (FIGS. 5 and 10) from the structure 10. The structure 10 may comprise a blast plate 32 (FIGS. 5 and 10) mounted to the underside 24 of the vehicle 12 as illustrated in FIG. 1. The trailing edges 70 (FIGS. 5 and 10) of the vanes 64 may be offset from the vehicle 12 underside 24 by an offset distance d such that a gap 80 (FIGS. 5 and 10) is formed between the vane trailing edges 70 (FIGS. 5 and 10) and the blast plate 32 or structure 10. The gap 80 is preferably sized to allow the airflow 82 (FIG. 1) to flow unimpeded toward the exit 58 (FIG. 1) of the diffuser assembly 54.

Step 306 may comprise directing airflow 82 (FIG. 1) of the overpressure wave 42 (FIG. 1) into an entrance 56 (FIG. 1) of the blast diffuser 52. As illustrated in FIG. 1, the entrance 56 to the blast diffuser 52 may comprise the location at the leading edges 68 (FIGS. 5, 10) of the vanes 64 where the overpressure wave 42 may enters the spacings $s_v$ (FIGS. 5, 10) between the vanes 64.

Step 308 may comprise passing the overpressure wave 42 (FIG. 1) airflow 82 (FIG. 1) through the vanes 64 (FIG. 1). The vanes 64 may include one or more braces 76 (FIG. 2) to interconnect the vanes 64 and thereby increase the stiffness and/or strength of the vanes 64. In this regard, the braces 76 may prevent deflection of the vanes 64 to the extent that the vanes 64 contact the blast plate 32 (FIG. 1) of structure 10. The braces 76 may also be oriented in a manner to redirect the airflow 82 away from the structure 10.

Step 310 may comprise redirecting the airflow 82 (FIG. 1) of the overpressure wave 42 (FIG. 1) toward a second direction 46 (FIG. 1) generally parallel to the side of the structure 10 (FIG. 1). The airflow 82 may be redirected or turned toward the second direction 46 when the airflow 82 passes through the vanes 64 due to the vane 64*b* curvature (FIG. 10) and/or due to the vane angle $\theta_v$ (FIG. 5) of the vanes 64*a*. For example, as indicated above, the vanes 64*a* may be oriented at a vane angle $\theta_v$ of between approximately 35 degrees and 65 degrees relative to the entrance plane 56*a* (FIG. 5) although the vanes 64*a* may be oriented at vane angles $\theta_v$ outside of the 35-65 degree range. For curved vanes 64*b* (FIG. 10), the leading edge 68 (FIG. 10) of the curved vanes 64*b* may be oriented approximately perpendicular to the entrance plane 56*a* (FIG. 10) of the vanes 64*b* although the leading edge 68 may be oriented at any angle. The airflow 82 may be redirected or turned toward the second direction 46 due to the curvature of the vanes 64*b*. Advantageously, the redirection of the airflow 82 deflects the overpressure wave 42 that may otherwise directly impact the structure 10 or vehicle 12.

Step 312 may comprise passing the airflow 82 (FIG. 1) along the gap 80 (FIG. 1). The airflow 82 may require a progressive increase in height of the gap 80 to accommodate contributions to the airflow 82 from each set of vanes 64 (FIG. 1) as the airflow 82 moves toward the exit(s) 58 (FIG. 1) of the diffuser assembly 54. The blast diffuser 52 may be configured such that the gap 80 progressively increases along a direction from one end of the blast diffuser 52 to an opposite end of the blast diffuser 52. The gap 80 may also increase along a direction from an approximate center of the blast diffuser 52 toward the opposing ends 16*a*, 16*b* (FIG. 1) of the blast diffuser 52. However, the blast diffuser 52 may be configured such that the gap 80 is constant along the length of the blast diffuser 52.

Step 314 may comprise discharging the airflow 82 (FIG. 1) at the exit 58 (FIG. 1) of the blast diffuser 52 (FIG. 1). The exit 58 may be located at one of the ends 16*a*, 16*b* (FIG. 1) of the blast diffuser 52 for blast diffusers having vanes 64 oriented in a common direction as illustrated in FIGS. 4 and 9. Alternatively, the blast diffuser 52 may include exits 58 at both of the ends 16*a*, 16*b* for blast diffusers 52 having vanes 64 oriented in opposite directions as illustrated in FIG. 14. For blast diffusers 52 mounted to the underside 24 of a vehicle 12 as illustrated in FIGS. 1-2, the airflow 82 of the overpressure wave 42 may be directed generally toward a perimeter 14 of the vehicle 12 to thereby redirect impact of the overpressure wave against the vehicle 12.

Many modifications and other embodiments of the disclosure will come to mind to one skilled in the art to which this disclosure pertains having the benefit of the teachings presented in the foregoing descriptions and the associated drawings. The embodiments described herein are meant to be illustrative and are not intended to be limiting or exhaustive. Although specific terms are employed herein, they are used in a generic and descriptive sense only and not for purposes of limitation.

What is claimed is:

1. A blast diffuser for a structure, comprising:

a diffuser assembly, including:

a plurality of vanes arranged in spaced relation to one anther;

the vanes being configured to redirect airflow of an overpressure wave from a first direction toward the diffuser assembly to a second direction generally parallel to the structure;

the vanes being offset from the structure by an offset distance forming a gap for the airflow between the vanes and the structure; and the vanes having end edges being attached to support brackets positioned in spaced relation to one another, the vanes extending between the support brackets.

2. The blast diffuser of claim 1 wherein:

the structure comprises a vehicle having an underside and a perimeter; and the diffuser assembly being mounted to the underside and positioned to redirect the overpressure wave toward the perimeter.

3. The blast diffuser of claim 2 wherein:

the gap is at least approximately 0.25 inch.

4. The blast diffuser of claim 2 further comprising:

a blast plate mounted to the structure; and the diffuser assembly being mounted over at least a portion of the blast plate.

5. The blast diffuser of claim 2 wherein:

at least one of the vanes has at least one of a planar configuration and a curved configuration.

6. The blast diffuser of claim 2 wherein:

the vanes have a thickness of between approximately 0.10 and 2.00 inches.

7. The blast diffuser of claim 2 wherein:

the vanes have a height of between approximately 0.25 inch and 24 inches.

8. The blast diffuser of claim 2 wherein:

the vanes are spaced apart from one another at a vane spacing of from approximately 0.5 inch to 10 inches.

9. The blast diffuser of claim 2 wherein:

the vanes each include a leading edge and a trailing edge;

the leading edges defining an entrance plane to the diffuser assembly; and the vanes being arranged such that the leading edge of at least one vane overlaps the trailing edge of an adjacent one of the vanes when the vanes are viewed along a direction approximately perpendicular to the entrance plane.

10. The blast diffuser of claim 9 wherein:

at least one of the vanes is oriented at an angle of between approximately 10 degrees and 80 degrees relative to the entrance plane.

11. The blast diffuser of claim 2 further comprising:

at least one brace interconnecting at least one pair of the vanes.

12. The blast diffuser of claim 11 further comprising:

at least one connector connecting at least one of the braces to at least one of the following: the structure, a blast plate mounted to the structure.

13. The blast diffuser of claim 1 wherein:

the structure comprises at least one of a vehicle, a building, a dam, a tunnel, a bridge.

* * * * *